US005192223A

United States Patent [19]

Gerke et al.

[11] Patent Number: 5,192,223

[45] Date of Patent: Mar. 9, 1993

[54] WIRE CONNECTOR FOR CABLE WIRE, IN PARTICULAR OF TELECOMMUNICATION CABLES

[75] Inventors: Dieter Gerke; Manfred Müller, both of Berlin, Fed. Rep. of Germany

[73] Assignee: Krone Akiengesellschaft, Fed. Rep. of Germany

[21] Appl. No.: 605,952

[22] Filed: Oct. 30, 1990

[30] Foreign Application Priority Data

Nov. 15, 1989 [DE] Fed. Rep. of Germany ..... 3938365

[51] Int. Cl.[5] ..... H01R 4/24

[52] U.S. Cl. ..... 439/402; 439/406

[58] Field of Search ..... 439/392, 395, 400, 402–404–406, 439/412, 417, 418, 396

[56] References Cited

U.S. PATENT DOCUMENTS 3,233,206 2/1966 Fiala ..... 439/402

3,576,518 4/1971 Bazille et al. ..... 439/402

3,804,971 4/1974 Bazille, Jr. ..... 439/299

3,899,236 8/1975 Santos ..... 439/402

4,822,298 4/1989 Gerke et al. ..... 439/402

*Primary Examiner*—Larry I. Schwartz

*Assistant Examiner*—Hien D. Vu

[57] ABSTRACT

The invention relates to a wire connector for cable wires, in particular of telecommunication cables.

The invention provides housing sections 2, 2' are constructed identically, and are adapted to be snap-fitted with each other after being rotated by 180 degrees relative to each other, that the crosspieces 6, 7 between the guide channels 8, 9 form the press-in sections, that the snap-fit elements are formed of the side walls 4, 5 of the housing sections 2, 2' extending parallely to the guide channels 8, 9 and that on the inner side of the longer side wall 4 is provided a receiving groove 11 for the other, shorter side wall 5 of the housing section 2, 2'.

8 Claims, 5 Drawing Sheets

WIRE CONNECTOR FOR CABLE WIRE, IN PARTICULAR OF TELECOMMUNICATION CABLES

FIELD OF THE INVENTION

The invention relates generally to a wire connector for cable wires, and in particular to telecommunication cables. The invention comprises a lower housing section with at least two parallel guide channels for receiving the cable wires and cutting/clamping contact inserts for electrical connection of the cable wires.

BACKGROUND OF THE INVENTION

A similar wire connector of the mentioned type is known in the art from German reference DE 37 11 675 Al. Herein, cable wires of a pair of wires are placed into the guide channels of a lower housing section and are then pressed into the cutting/clamping contact elements of the lower housing section by means of the crosspieces of a first upper housing section. Cutting-off of the cable wires may be effected by separating knives disposed in the lower housing section. Thereafter, the cable wires of a second pair of wires are placed into the corresponding guide channels of the lower housing section and are pressed into the cutting/clamping contact elements of the lower housing section by means of the crosspieces of a second upper housing section. According to this reference, cutting-off of the cable wires can also be effected by separating knives disposed in the lower housing section. It is disadvantageous, herein, that different housing sections are required, namely the lower housing section forming the guide channels and receiving the cutting/clamping contact elements and possibly the separating knives and the two cover-type upper housing sections with the crosspieces for pressing the cable wires into the cutting/clamping contact elements of the lower housing section. The prior art wire connector has, further, a relatively large constructional size.

SUMMARY AND OBJECTS OF THE INVENTION

The invention is based, therefore, on the object to provide a wire connector of the above mentioned species, where the wire connector is constructed in a simpler manner, so that the manufacturing costs for the housing sections can be reduced, and where the wire connector being of a small constructional size.

According to the invention, a lower housing section is provided with at least two parallel guide channels for cable wires wherein the guide channels are separated by crosspieces. Cutting/clamping contacts are inserted into the guide channels. An upper housing section is provided with crosspieces for pressing cable wires into the cutting/clamping contact elements of the lower housing section. Snap-fit elements are provided on each housing for latching the upper and lower sections. Each of the housing sections together are constructed to be identical and are adapted to be snap-fitted into each other after one of the housing sections is rotated 180 degrees relative to the other. The crosspieces provided between the guide channels each form press-in sections. The snap-fit elements are formed on the side walls of the housing sections which extend substantially parallel to the guide channels. The side walls include a longer housing wall and an opposite shorter side wall. The longer housing wall is provided with a receiving groove for receiving the shorter side wall of the other housing sections.

According to the invention, both housing sections are constructed identically, and are adapted to be snap-fitted together after being positioned by a rotation of 180 degrees, relative to each other. Herein, the crosspieces between the guide channels from the press-in sections for the cable wires. The press-in sections of one housing section pressing the cable wires into the cutting/clamping contact elements of the other housing section when closing the wire connector. A special cover piece in the form of an upper housing section is not required. Further, the snap-fit elements are formed on the side walls of the housing sections and extend parallel to the guide channels. Further, on the inner side of the longer side wall of each housing section there is provided a receiving groove for the other, shorter side wall of the other housing section. In each housing section a pair of cable wires is received and pressed into each other by the cutting/clamping contact elements when the wire connector is closed. By the identical construction of both housing sections a substantially simplified construction of the wire connector according to the invention is achieved, such that it can be manufactured simply and economically. Further, the wire connector requires only a small constructional size, as it has a cubic shape when closed.

According to another feature of the invention, the outside of the shorter side wall is formed with latching projections which engage into corresponding latching grooves on the inner side of the longer side wall. In between the longer side wall and the first press-in section, the receiving groove is formed. A guide channel is formed between the two press-in sections and another guide section is provided between a second press-in section and the shorter side wall. A resilient blocking lug is associated with each of the guide channels at both ends. The blocking lug extends from the press-in sections transversely over the guide channels. Each of the cutting/clamping contact elements extends at an angle of preferably 30 degrees obliquely through both guide channels. The ends of each cutting/clamping contact element is provided with a separating knife element which each extend at ends of the guide channels transversely over the guide channels.

A further object of the invention is to provide a wire connector which is advantageous in its design, rugged in its constructions and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
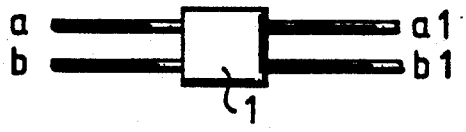
FIG. 1 is a top view of the wire connector in a 1:1 scale with two pairs of wires connected thereto.

The wire connector 1 serves for the connection of wire pairs a, b and, a1, b1 with each other. The wire connector 1 is substantially of cubic shape with an edge length of approx. 10–12 cm. It is composed of two identically constructed housing sections 2, 2' which are adapted to be snap-fitted together after rotating one housing section by 180 degrees relative to the other.

Each housing section 2, 2' comprises a bottom 3, a longer side wall 4, a shorter side wall 5, and two crosspieces 6, 7 extending in a parallel manner with respect to the side walls 4 and 5 and are fixed to the bottom 3. The crosspieces 6, 7 form the pressed-in sections for the cable wires a, b; a1, b1, as will be described below. The two side walls 4, 5 and the two crosspieces 6, 7 which extend in the parallel manner to each other are made as one piece each together with the bottom 3. A first guide channel 8 extends between the two crosspieces 6, 7. A second guide channel 9 for the cable wires a, b; a1, b1 extends between the crosspiece 7 and the shorter side wall 5. Transversely to the guide channels 8, 9 there extends, at the height of the upper edges of the crosspieces 6, 7, blocking lugs 10 each directed from the crosspiece 6 to the opposed crosspiece 7 and from crosspiece 7 to the opposed shorter side wall 5. The blocking lugs 10 serve for protecting the cable wires a, b; a1, b1 inserted into the guide channels 8, 9 against falling out.

Between the longer side wall 4 and the first press-in section 6 there extends a receiving groove 11 parallel to the longer side wall and to the press-in section 6. The receiving groove 11 is as long as the shorter side wall 5 and is also open on the side of the bottom 3 except for a central bridge section 12. The bridge section 12 is opposed by a slot 13 subdividing partially the shorter side wall 5. The shorter side wall 5 has on its outside latching projections 14 to which are assigned on the inner side of the longer side wall latching grooves 15 which are open toward the receiving groove 11.

Figure 2A:
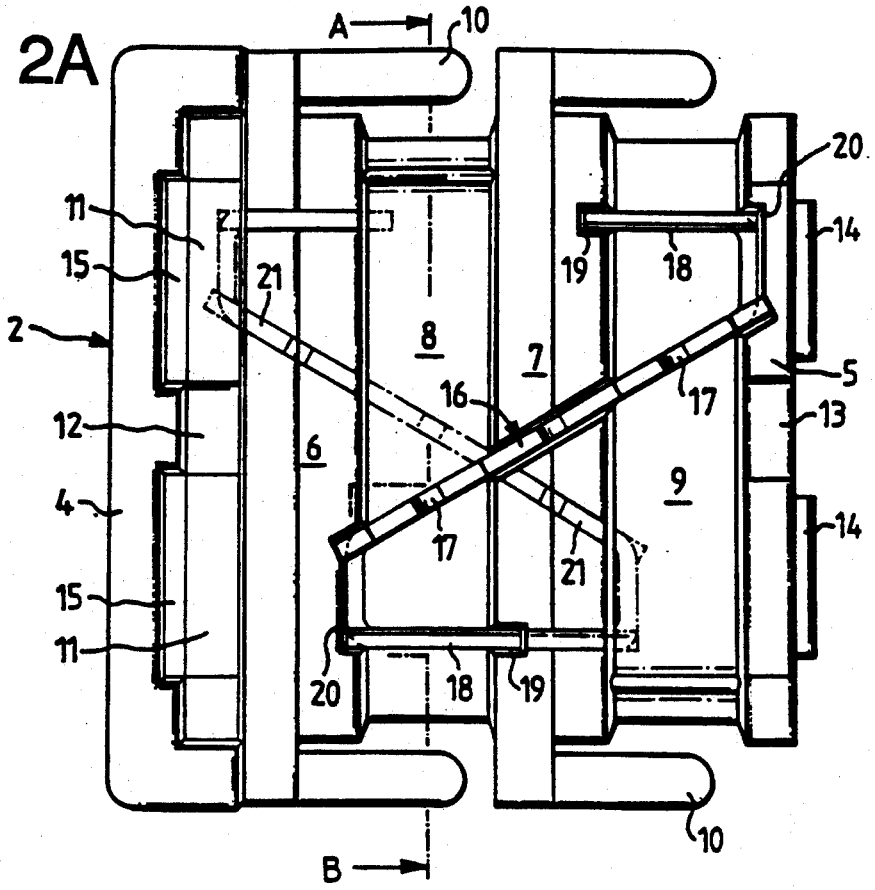
FIG. 2A is a top view of a housing section enlarged in a 10:1 scale.
Figure 3:
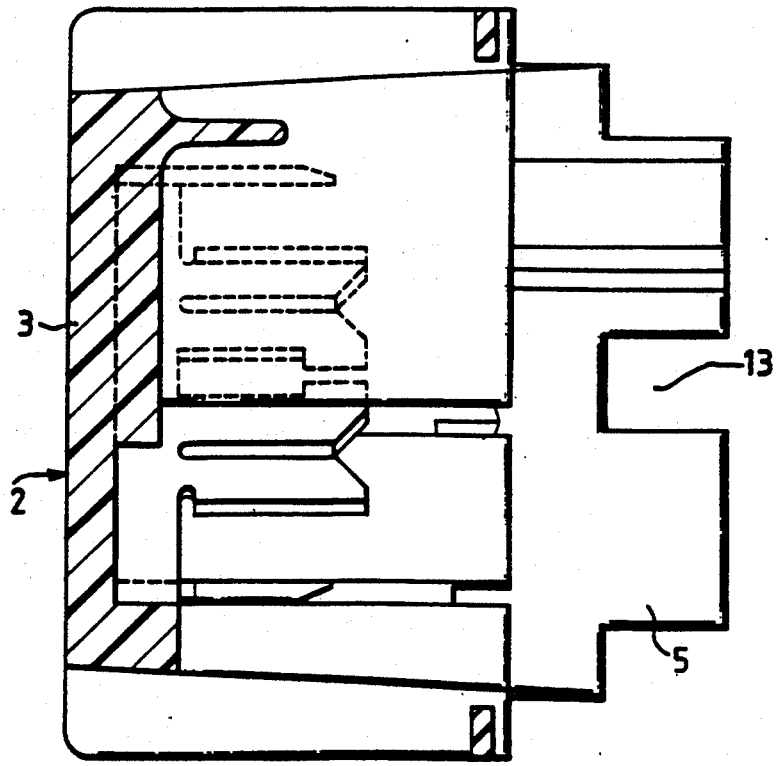
FIG. 3 is a sectional view taken along line A–B of FIG. 2 through the housing section.
Figure 2B:
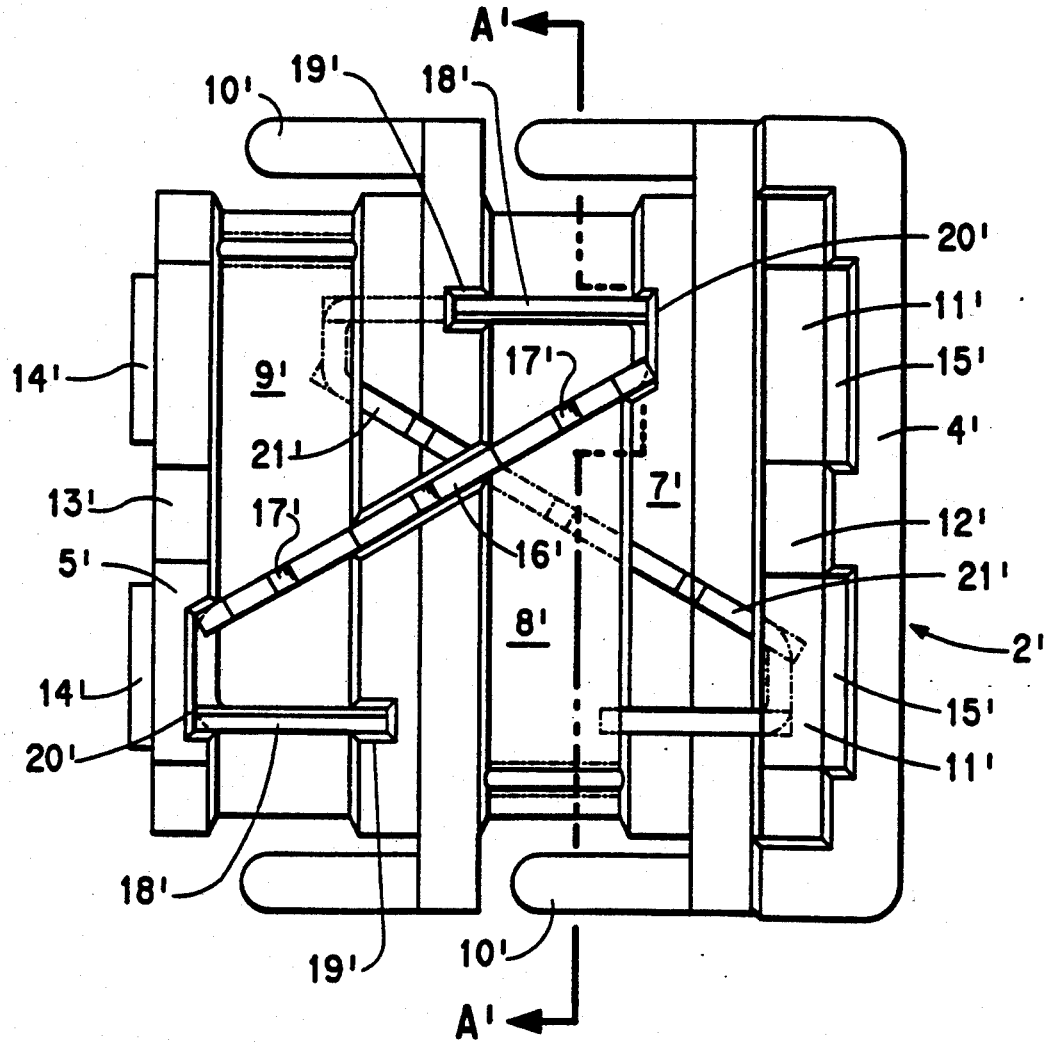
FIG. 2B is a top view of another housing rotated 180 degrees and positioned with respect to FIG. 2A to show an interrelationship between an upper and lower housing.
Figure 4B:
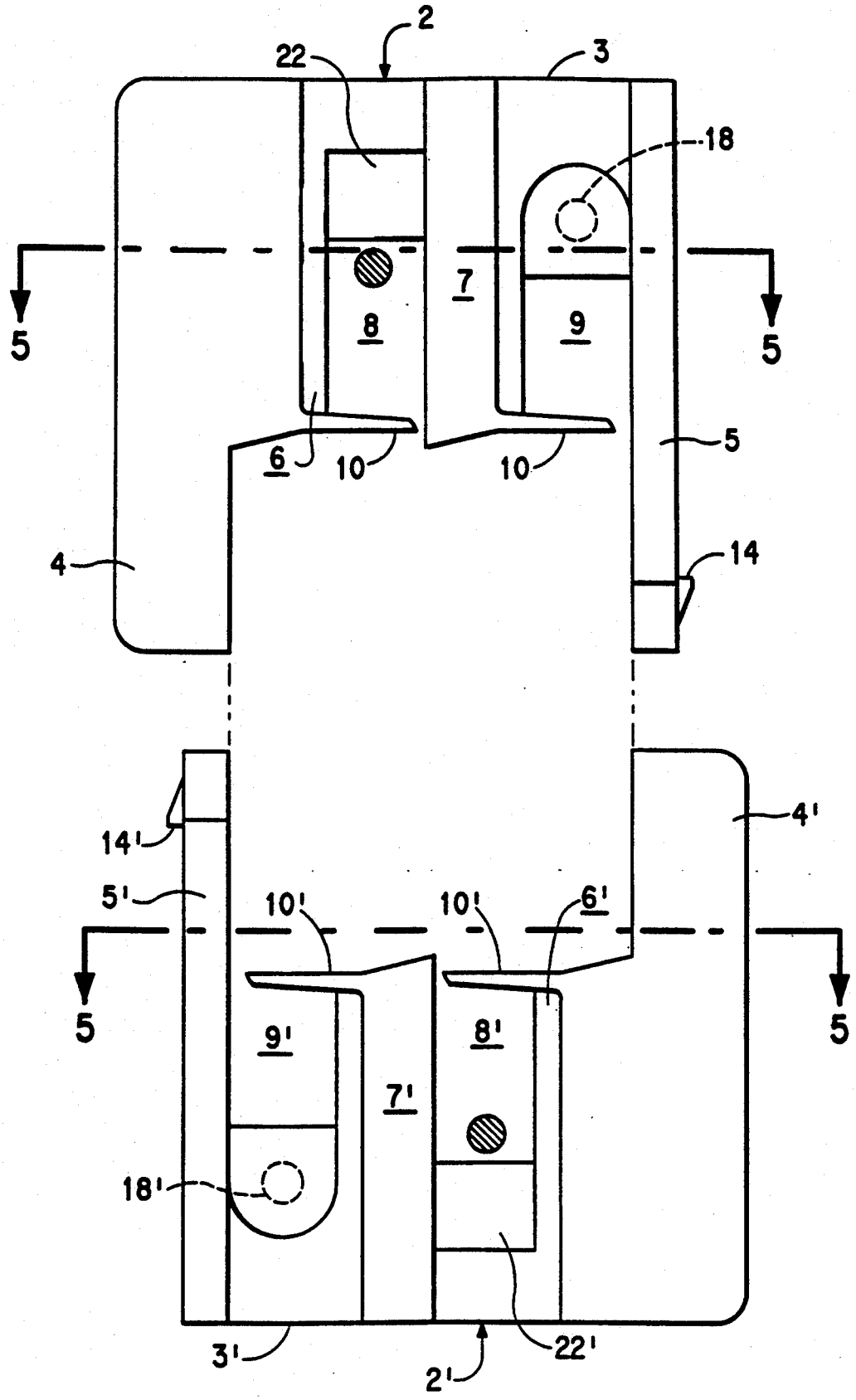
FIG. 4B is a front view of the connector with the upper and lower housing positioned just before insertion into each other.
Figure 5:
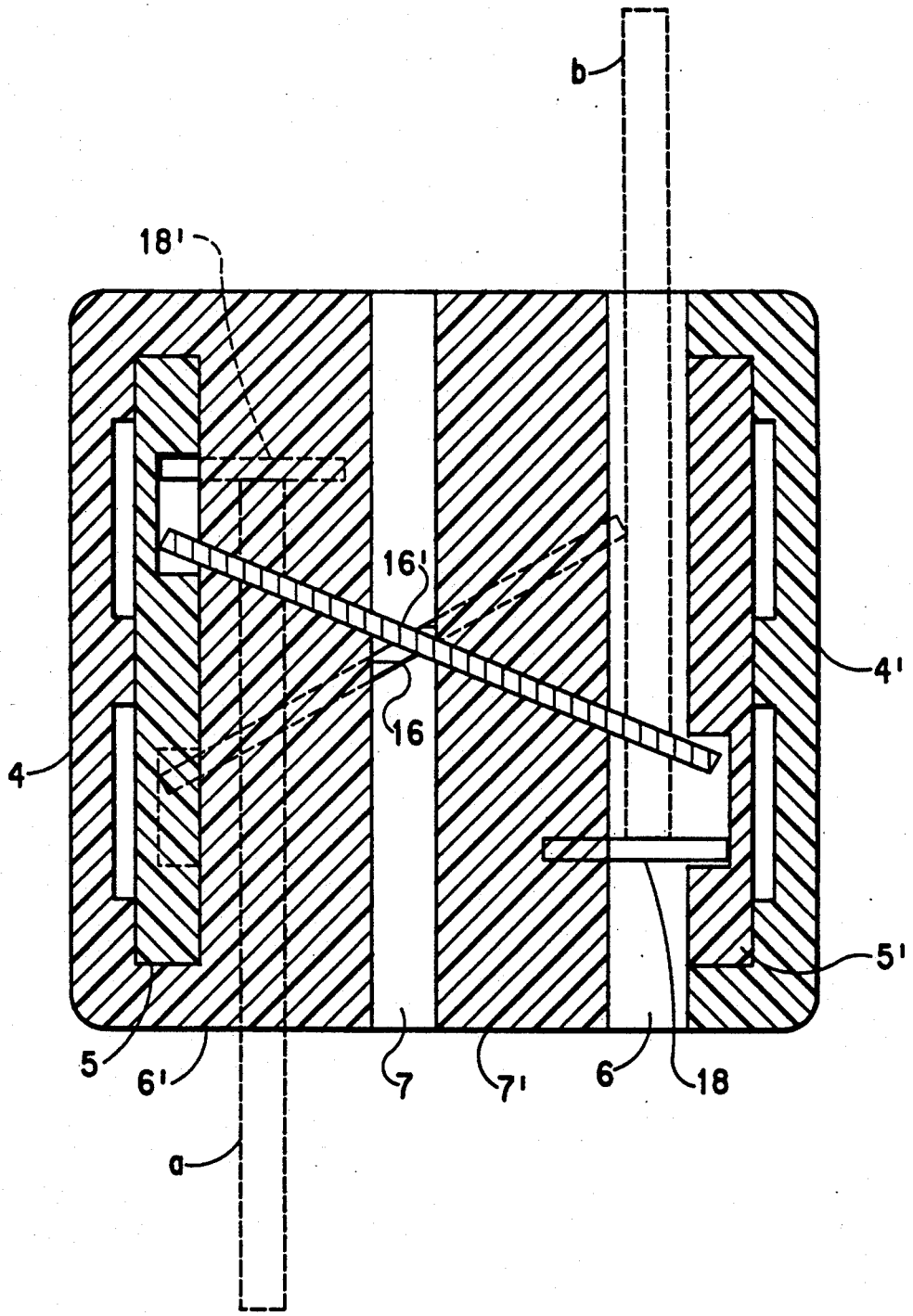
FIG. 5 is a crossectional view through the section line V—V in FIGS. 4A and 4B.

As can be seen from FIG. 2A and from the above description, into the housing section 2 according to FIG. 2A there can be inserted an identically constructed further housing section 2' in a position reversed by 180 degrees. In this way the shorter side walls 5 of each housing section 2, 2' engage into the receiving grooves 11 of the respective other housing section 2, 2', the length of the shorter side wall 5 is equal to or slightly shorter than the length of the receiving groove 11. The latching projections 14 of the housing section 2 slide latching grooves 15, of the housing section 2 and the slot 13 of housing section 2 engages over the bridge 12 of housing section 2' when the two housings are combined. In this way, two identically constructed housing sections 2, 2' can be snap-fitted with each other to obtain a cubic wire connector 1.

In the guide channels 8, 9 of each housing section 2, 2' there are disposed cutting/clamping contact elements 16 intersecting at an angle of approximately 30 degrees the guide channels 8, 9. The cutting/clamping contact element 16 forming in each guide channel 8, 9 a contact slot 17 for the cable wires a, b; a1, b1. Each cutting/clamping contact element 16 is connected on both ends in a one-piece manner with a bent-off separating knife 18. One separating knife 18 being provided on one end of each guide channel 8, 9 and extending transversely thereto. For receiving and fixing the cutting/clamping contact elements 16 and the associated separating knives 18, grooves 19 and slots 20 are provided in the press-in sections 6, 7 and in the shorter side wall 5, as is shown in FIG. 2A. In the press-in sections 6, 7 there are provided, transverse slots 21, into which the cutting/clamping contact element 16 of the other housing section 2' engages when closing the wire connector 1. The cutting/clamping contact element 16 of the other housing section 2' is so disposed after its reversal by 180 degrees, symmetrically with respect to the cutting/clamping contact element 16 of the first housing section 2.

For connecting two pairs of wires a, b; a1, b1, the a and a1 wires are inserted into a housing section 2, the b and b1 wires into a housing section 2'. When doing so, the blocking lugs 10 are bent off for a short time, and thereby form a protection for the cable wires against falling out. Thereafter, the two housing sections 2, 2' with inserted cable wires a, b; a1, b1 are brought above each other, and the shorter side walls 5 are introduced into the receiving grooves 11. Then, the press-in section 6, 7 of one housing section 2 are disposed above the guide channels, 8, 9 of the other housing section 2'. The press-in sections 6, 7 of housing 2' are thereof, in turn, disposed above the guide channels 8, 9 of the other housing section 2. When pressing the two housing sections 2, 2' together, the press-in section 6, 7 of each housing section 2, 2' will press the cable wires a, al or b, b1 respectively, into the guide channels 8, 9 of the respective other housing section 2, 2'. By this arrangement the two pairs of cable wires a, al and b, b1 are conductively connected with each other over the cutting/clamping contact elements 16 which are made of conductive metal material. The latching projections 14 of each shorter side wall 5 will snap-fit into the end of the latching grooves 15 of the longer side wall 4, so that the wire connector 1 is latched and is hermetically sealed. For protecting the contact connections against humidity, grease may be applied in the interior of the housing sections 2, 2' prior to closing.

Figure 4A:
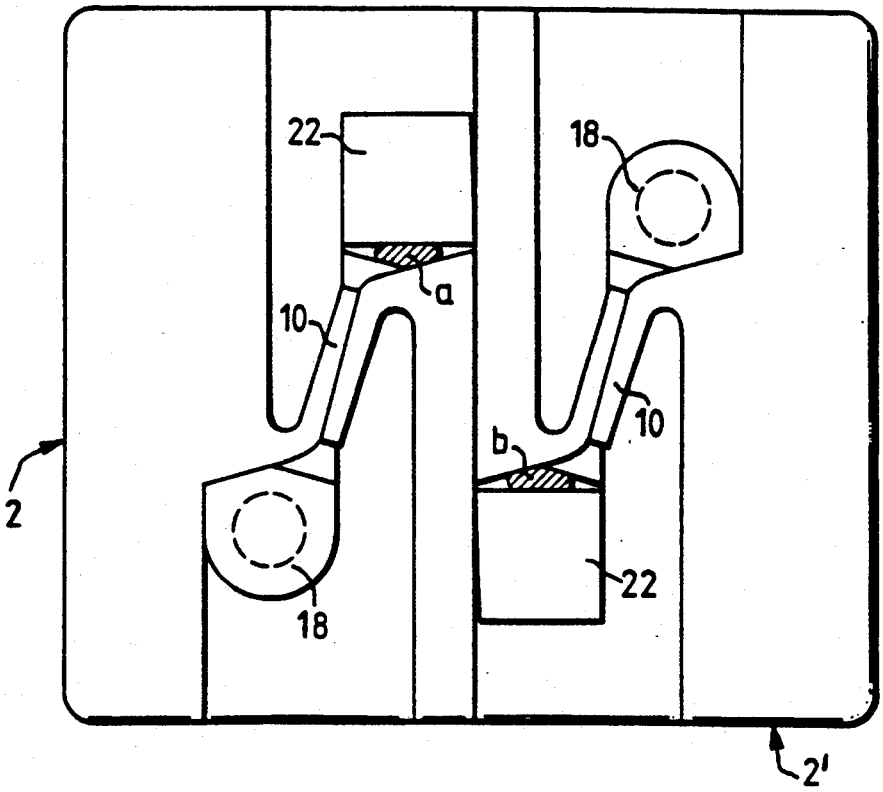
FIG. 4A is a front view in a 10:1 scale of the closed wire connector.

FIG. 4A shows a view of the closed wire connector 1 in a 10:1 scale with the a, b wires of one pair of wires a, b being visible. The wires are held in position by clamping pieces 22 at the ends of the guide channels 8, 9. The blocking lugs 10 are pressed against each other, and are bent off.

While a specific embodiment of the invention has been shown and described in detail to illustrate the application of the principles of the invention, it will be understood that the invention may be embodied otherwise without departing from such principles.

What is claimed is:

1. A wire connector for cable wires, such as telecommunication cables, comprising:

a lower housing section defining at least two substantially parallel guide channels for receiving cable wires, each guide channel having a side defined by crosspieces, said lower housing section having side walls extending substantially in parallel with said guide channels, said side walls including a longer side wall and a shorter side wall, said longer side wall including a receiving groove shaped complimentary to said shorter side wall;

an upper housing section substantially identical to said lower housing section;

cutting/clamping contacts positioned in the guide channels of said lower housing section;

snap-fit elements connected to each of said housing sections, said housing sections being snap-fit together after rotating one of the housing sections 180 degrees relative to the other one of said housing sections, said crosspieces of said upper housing section forming a press-in section for pressing cables wires into the cutting/clamping contact elements of the lower housing section, said snap-fit elements being formed one on each of said side walls of each of the housing sections.

2. A wire connector according to claim 6, wherein an outside surface of the shorter side wall is formed with latching projections, each of said longer side walls including an inner side with a corresponding latching groove for receiving the latching projection of the shorter side wall of the other housing section.

3. A wire connector according to claim 1, wherein each guide channel is associated at both ends with one resilient blocking lug, each blocking lug extending from an associated press-in section transversely over said guide channel.

4. A wire connector according to claim 1, wherein each cutting/clamping contact element extends at an angle of substantially 30 degrees obliquely through each guide channel, ends of each cutting/clamping contact element including a separating knife, each separating knife being fitted at ends of the guide channels and extending transversely over the guide channels.

5. A wire connector in accordance with claim 1, wherein:

one of said guide channels is formed between said shorter side wall and one of said crosspieces, another of said guide channels is formed between two of said crosspieces, and a receiving groove is formed between said longer side wall and another one of said crosspieces.

6. A wire connector housing in accordance with claim 1, wherein:

said cutting/clamping contacts electrically connect two wires.

7. A wire connector housing in accordance with claim 6, wherein:

said another substantially identical wire connector housing is interconnected physically with the wire connector housing, said another wire connector housing electrically connecting another two wires.

8. A wire connector for cable wires, such as telecommunication cables, comprising:

a lower housing section defining at least two parallel guide channels for receiving cable wires, each guide channel having a side defined by crosspieces said lower housing section having side walls extending substantially in parallel with said guide channels, said side walls including a longer side wall and a shorter side wall, said longer side wall including a receiving groove shaped complimentary to said shorter side wall;

an upper housing section defining at least two parallel guide channels for receiving cable wires, each guide channel having a side defined by crosspieces said upper housing section having side walls extending substantially in parallel with said guide channels, said side walls including a longer side wall and a shorter side wall, said longer side wall including a receiving groove shaped complimentary to said shorter side wall, said upper housing section being substantially identical to said lower housing section;

a cutting/clamping contacts inserted into the guide channels of said lower housing section;

snap-fit elements connected to each of said housing sections, said housing sections being snap-fit together after rotating one of the housing sections 180 degrees relative to the other one of said crosspieces of said upper housing section forming a press-in section for pressing cable wires into the cutting/clamping contact elements of the lower housing section, said snap-fit elements being complimentary formed one on each of said side walls of each of the housing sections.

* * * * *

UNITED STATES PATENT AND TRADEMARK OFFICE

CERTIFICATE OF CORRECTION

PATENT NO. : 5,192,223
DATED : March 9, 1993
INVENTOR(S) : Gerke et al

It is certified that error appears in the above-identified patent and that said Letters Patent is hereby corrected as shown below:

On the title page,

[73] Assignee: Krone Aktiengesellschaft, Fed. Rep. of Germany the Attorney, Agent or Firm data as follows:

*Attorney, Agent or Firm* - McGlew and Tuttle, P.C.

Signed and Sealed this

Twenty-third Day of November, 1993

*Attest:*

*Attesting Officer*

Bruce Lehman

BRUCE LEHMAN

*Commissioner of Patents and Trademarks*